United States Patent [19]

Nolte et al.

[11] Patent Number: 4,478,282

[45] Date of Patent: Oct. 23, 1984

[54] HEIGHT CONTROL TECHNIQUE IN HYDRAULIC FRACTURING TREATMENTS

[75] Inventors: Kenneth G. Nolte; Michael B. Smith, both of Tulsa, Okla.

[73] Assignee: Standard Oil Company, Chicago, Ill.

[21] Appl. No.: 366,369

[22] Filed: Apr. 7, 1982

[51] Int. Cl.[3] ..... E21B 43/267

[52] U.S. Cl. ..... 166/281; 166/308; 166/280

[58] Field of Search ..... 166/259, 271, 280, 281, 166/283, 284, 285, 292, 308

[56] References Cited

U.S. PATENT DOCUMENTS

| | | | |
|---|---|---|---|
| 3,127,937 | 4/1964 | McGuire, Jr. et al. | 166/281 |
| 3,460,622 | 8/1969 | Davis, Jr. | 166/308 |
| 3,757,862 | 9/1973 | Kern et al. | 166/281 |
| 3,954,142 | 5/1976 | Broaddus et al. | 166/308 |
| 3,998,271 | 12/1976 | Cooke, Jr. et al. | 166/281 |
| 4,143,715 | 3/1979 | Paulich | 166/308 |
| 4,186,802 | 2/1980 | Perlman | 166/308 |

OTHER PUBLICATIONS

Plugging Thief Zones in Water Injetion Wells, Robertson, Jr. et al., 1967, Journal of Petroleum Tech.

*Primary Examiner*—Stephen J. Novosad
*Assistant Examiner*—William P. Neuder
*Attorney, Agent, or Firm*—Scott H. Brown; Fred E. Hook

[57] ABSTRACT

To control adverse vertical height growth of the fracture created during hydraulic fracturing treatments of subterranean formations, a nonproppant fluid stage is injected during the treatment. The nonproppant stage comprises a transport fluid and a flow block material. The flow block material can be any particulate used as a fracture proppant, and has a particle size distribution which is sufficient to form a substantially impermeable barrier to fluid flow into the vertical extremities of the fracture. The particle size distribution preferably comprises at least two different particles sizes.

3 Claims, 4 Drawing Figures

HEIGHT CONTROL TECHNIQUE IN HYDRAULIC FRACTURING TREATMENTS

BACKGROUND OF THE INVENTION

1. Field of the Invention

The present invention relates generally to methods for hydraulically fracturing hydrocarbon bearing subterranean formations, and more particularly relates to methods for control of the vertical height of the fracture created in a subterranean formation by hydraulic fracturing procedures.

2. Setting of the Invention

In the completion of wells through hydrocarbon bearing rock formations, noncommercial wells often result because of low permeability to flow of hydrocarbons through the formation to the wellbore. This problem can be overcome by treating the formation in a manner designed to increase fluid flow toward the wellbore.

Hydraulic fracturing is a widely used well stimulation technique designed to increase the productivity of the well by creating fractures in the formation penetrated by the well to improve fluid flow through the formation. The technique normally involves injecting a fluid into the formation at a rate and pressure sufficient to propagate a fracture adjacent to the well. The fluid contains propping agents, termed proppants, for propping open the fracture and maintaining fluid conductivity through the fracture when the pressure applied during injection of the fracturing fluid is relieved.

During these hydraulic fracturing processes, however, it is often advantageous to confine the induced fracture to the particular formation being treated. It is therefore desirable that the fracture extend horizontally away from the wellbore with minimal growth of the fracture in a vertical direction. Confinement of the fracture is often achieved because of higher in-situ rock stresses in the overlying and underlying rock formations than the stresses in the formation being treated. However, during some hydraulic fracturing treatments, vertical height of the induced fracture occurs and the fracture grows out of the desired formation upward and/or downward. This vertical height growth can lead to a premature screenout of the treatment. A screenout occurs when the proppant becomes immobile at the leading edge of the fracture and prevents additional fluid injection and desired horizontal extension of the fracture. Vertical height growth into an adjacent water zone can affect subsequent production of desired hydrocarbons from the well. Moreover, vertical height growth increases the amount of fracturing fluid needed to achieve the desired horizontal extension, thus increasing costs of a treatment. Consequently, techniques for control of the vertical height of the induced fracture during hydraulic fracturing treatments are important to prevent waste, inefficient extension, and growth into undesirable adjacent zones.

One such technique for height control during hydraulic fracturing is proposed in Cleary "Analysis of Mechanisms and Procedures for Producing Favorable Shapes of Hydraulic Fractures," SPE 9260, 55th Annual Fall Technical Conference and Exhibition of the Society of Petroleum Engineers of AIME, Sept. 21–24, 1980. Cleary describes a technique for height control using "heavy/light particles, mixed with the frac fluid" which settle and rise to the bottom and top of the fracture and reduce the flow transmissivity where the particles congregate. FIG. 5 of the Cleary article shows the heavy/-light particles are proppant and buoyant beads.

U.S. Pat. No. 3,335,797, "Controlling Fractures During Well Treatment," issued to F. H. Braunlich, Jr., on Aug. 15, 1967, claims a procedure for hydraulic fracturing to create "a fracture pattern which may progress to a greater extent outwardly and upwardly and to a lesser extent downwardly." Braunlich employs a particulate propping agent of particle size "between about 20 and about 60" to "pack together sufficiently to divert subsequently injected liquids but retain some permeability. "

To Applicant's knowledge, however, it is previously undisclosed to inject during a hydraulic fracturing treatment a nonproppant fluid stage which denies fluid flow into the vertical extremities of the fracture, and thus controls vertical height growth in both uphole and downhole directions.

SUMMARY OF THE INVENTION

During a hydraulic fracturing treatment of a subterranean formation penetrated by a wellbore, adverse vertical height growth of the induced fracture is controlled by an improvement comprising injecting a nonproppant fluid stage. The nonproppant fluid stage comprises a transport fluid and a flow block material of a particle size distribution sufficient to form a substantially impermeable block to fluid flow in a vertical direction. In one aspect the invention comprises first injecting into the formation a fracturing fluid pad at sufficient rate and pressure to open a fracture in the formation. The fracturing fluid pad is followed by injecting the nonproppant fluid stage to control vertical height growth of the fracture. A proppant laden slurry is then injected into the formation.

DETAILED DESCRIPTION OF THE INVENTION

Figure 1:
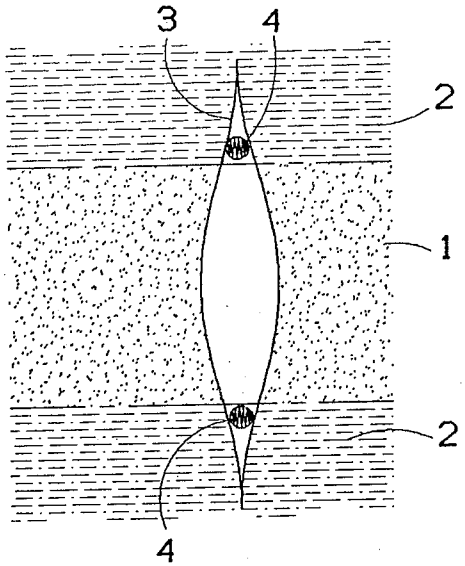
FIG. 1 depicts a phenomena occurring when adverse vertical height growth takes place during a fracturing treatment.

FIG. 1 illustrates a phenomena occurring during a hydraulic fracturing treatment when adverse vertical height growth of the induced fracture takes place. FIG. 1 looks away from a wellbore penetrating a subterranean formation and looks down an induced fracture 3 created by hydraulic fracturing. The induced fracture is created when a fluid is injected into the formation at a pressure higher than the formation's parting pressure. The fracture is shown penetrating a hydrocarbon bearing rock formation 1 being treated and overlying and underlying shale formations 2.

The phenomena stems from the smaller width of the fracture 3 in the shale zones 2 than that in the formation being treated. The fracture width in the shales is smaller because of higher in-situ stresses and/or higher elastic modulus in the shales. When a fluid slurry containing proppant particle 4 is injected during the treatment, the slurry moves to fill the fracture width in both the rock and shale formations, and the particle 4 may bridge as depicted in FIG. 1 in the shale zone where the fracture is narrower than the proppant size. This particle bridging denies flow of the proppant particles into the fracture growing in the vertical direction, yet permits fluid flow, although at reduced rate, past the bridge and into the fracture 3. The particle bridging thus eventually leads to slurry dehydration and screenout of the treatment. As more proppant laden slurry is injected into the fracture, fluid flow through the particle bridge and continues the vertical growth of the fracture. Eventually, enough fluid is removed from the proppant slurry so that it becomes dehydrated and a screenout occurs. The treatment must then be terminated. In addition, as bridging permits fluid flow and pressure in the fracture in the shale zone, the fracture can thus grow out of the shale zone into a lesser stressed formation. When the fracture grows into a lesser stress zone, rapid height growth takes place and accelerates slurry dehydration.

Using the method of the invention, Applicants have found that the occurrence of particle bridging during a fracture treatment can be utilized to control the vertical height growth of the fracture. Injection of a nonproppant fluid stage between injection of an initial pad of fracturing fluid and injection of a proppant-laden slurry controls vertical height growth of the induced fracture. The nonproppant fluid stage comprises a transport fluid and flow block particles of a particle size distribution sufficient to form a substantially impermeable block to fluid flow in a vertical direction. The sufficient particle size distribution contains larger particles to create the particle bridge and smaller particles to fill in the gaps between the larger particles, thus forming a substantially impermeable barrier to fluid flow. As fluid can no longer flow into the vertical growth of the fracture, fracture extension is confined to the horizontal direction.

Surprisingly, injection of the nonproppant stage using, for example, a sand mixture of different mesh size as the flow block material blocks vertical fluid flow in both the upward and downward direction. Injecting a sufficient particle size distribution of a particulate flow material in a nonproppant stage controls height in both vertical extremities of the fracture by taking advantage of particle bridging. The invention thus broadly comprises injecting a nonproppant fluid stage during a hydraulic fracturing treatment of a subterranean formation.

Figure 2:
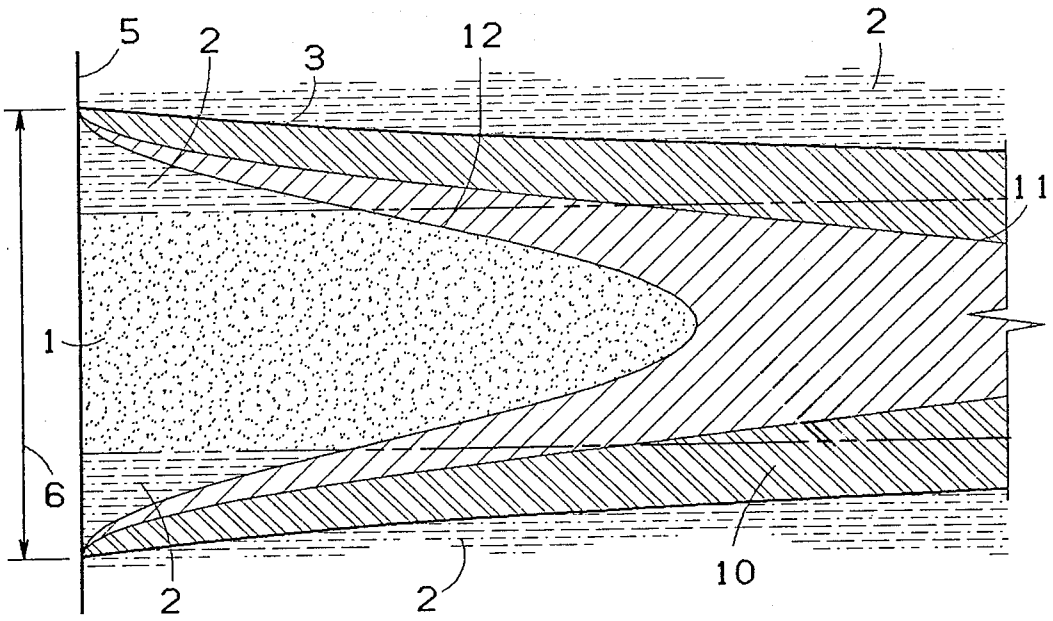
FIG. 2 shows fluid displacement profiles during a fracturing treatment.

FIG. 2 illustrates fluid displacement profiles during injection of fluids in a fracturing treatment. One side of wellbore 5 is shown penetrating rock formation 1 and confining shales 2. The fluid fronts for three different fluid stages are shown. A fracturing fluid pad 10 is first injected to initate and extend fracture 3 of overall vertical height 6. A second fluid stage 11 is then injected, followed by a proppant-laden fluid slurry 12. The Figure shows that each subsequent fluid entering the fracture 3 tends to displace fluid upwards and downward towards the fracture's height extremities. This vertical displacement would be enhanced by height growth.

The different injection stages of one aspect of the invention can be visualized from FIG. 2. The pad 10 is first injected in this aspect. The second fluid stage 11 corresponds to the nonproppant fluid stage. The proppant slurry 12 follows the nonproppant stage. However, the fluid displacement profile of the invention would differ from that shown in FIG. 2 in that the height control technique of the invention prevents additional fluid displacement in the vertical direction.

As noted, in one aspect the invention comprises first injecting a fracturing fluid pad. The fluid pad is injected to initiate a fracture in the underground formation, and must be injected under conditions of pressure and rate sufficient to initiate and extend the fracture. Such conditions are well-known to one of skill in the art. The actual volume of pad fluid injected should be sufficient to account for the nonproppant and proppant stages to follow, but in general, the volume of the pad is in the range of about 10% to 50% of the total volume of fluid injected, and preferably in the range of about 20% to about 40%. The exact volume employed will depend on the approximate volume and dimension of the fracture desired and can be calculated by one skilled in the art from particular formation parameters. The pad fluid also preferably has a low viscosity to minimize any height growth before injection of the nonproppant stage.

The composition employed as the pad fluid in general is any viscous non-Newtonian fluid capable of use as a fracturing fluid. For example, and without limitation to, the following fluids could be used: water gels, hydrocarbons gels and hydrocarbon-in-water, or optionally, water-in-hydrocarbon emulsions. Suitable water gels may be formed by combining water or certain brines with natural gums and derivatives thereof, such a guar or hydroxypropyl guar, carboxymethyl cellulose, carboxymethyl hydroxy ethyl cellulose, polyacrylamide and starches. Chemical complexes of the above compounds formed through chemical cross-linking may also be employed in the present invention. Such complexes may be formed with various metal complexers such as titanium, copper, nickel, and zirconium. Other suitable compositions can, of course, be used as the pad fluid. In addition, the pad fluid itself may consist of different fluids. For example, water, brine, or diesel oil may be injected ahead of the remainder of the pad fluid which comprises a different fluid.

Because the pad fluid is sacrificial in nature and is to provide fluid loss control for the entire treatment, it should have low fluid loss characteristics. If desired, fluid loss control additives such as, for example, 200 mesh, U.S. Sieve Series, particles of sand or silica flour can also be used in the pad.

After injection of the fracturing fluid pad, the nonproppant fluid stage is injected. As noted above, the nonproppant fluid takes advantage of particle bridging in the narrower width at the vertical extremities of the induced fracture. It is therefore preferable to inject the nonproppant stage under conditions which encourage vertical height growth. When this is done, particle bridging takes place more efficiently. One condition that can be used is to adjust injection rate of the nonproppant stage to aid in setting the substantially impermeable vertical flow block. Increasing the rate during the nonproppant injection encourages vertical height growth initially because the pressure on the formation is dependent on rate, and the pressure will therefore be increased. But as noted, once the larger particles bridge, the smaller particles will fill in the bridge and stop vertical flow.

Another condition which encourages height growth is adjusting relative viscosity differences between the different fluid stages of the invention. It is preferable that the viscosity of the nonproppant fluid stage is higher than that of the leading fracturing fluid pad, since as the pressure in the fracture is dependent on viscosity, a greater viscosity can increase height growth. Greater viscosity helps displace the pad fluid down the opened fracture. This also helps displace the flow block particles into the vertical extremeties of the fracture. A viscosity difference thus helps set the vertical flow block created by the nonproppant stage. It is believed that a viscosity up to about 50% greater than the viscosity of the pad fluid will be effective, although higher viscosities can be used. It is not necessary, however, that the relative viscosities of the fluid stages are different.

The volume of nonproppant stage injected will preferably be about 5% to about 20%, and more preferably about 5% to about 10%, of the volume of the proppant slurry injected, although lesser and greater amounts can be employed. For example, for a smaller size overall treatment, the nonproppant stage volume could be greater than 20%, without increasing the cost or decreasing the efficiency of the treatment. The 20% volume is preferable as the upper limit, however, because as the nonproppant stage becomes larger relative to the proppant slurry, it can reduce conductivity in the horizontal direction.

Some reduction in conductivity in the horizontal direction will occur from use of the nonproppant stage. This is so because a portion of the fracture will be propped open by the flow block material of the nonproppant stage. And since the flow block material is sized to reduce vertical fluid flow, a portion of the fracture may be of reduced horizontal conductivity. It is thus preferable to use as small a nonproppant stage as will be effective.

The transport fluid of the nonproppant stage comprises any fluid sufficient to transport the particular flow block materials employed. It can also be the same fluid as that employed in the fracturing fluid pad. For example, a water based hydroxypropyl-guar gel crosslinked with a metal can be used. Such a fluid has good transport properties due to the cross-linking. It is possible however to use a noncrosslinked gel as the transport fluid, because more severe vertical height growth occurs near the wellbore. Thus, the flow block material may not have to be transported over great horizontal distances. Applicants have found, however, that flow in both the uphole and downhole directions can be blocked with a nonproppant stage preferably using a cross-linked fluid as the transport fluid.

The flow block materials employed in the nonproppant stage can be any material capable of use as a fracture proppant. For example, sand, polymer-coated sand, glass beads, walnut shells, silica flour, alumina, sintered bauxite, or other particulate of suitable size can be used. The distinctiveness of the flow block material of the nonproppant stage is in the distribution of particulate sizes used.

The particle size distribution of the flow block material is any distribution sufficient to form a substantially impermeable barrier to vertical fluid flow. For example, the distribution will be of larger particles, e.g., 20 mesh, U.S. Sieve Series, with smaller particles, e.g., 100 mesh. Such a mixture of particle sizes is not used in current fracturing methods because of potential plugging of permeability created by the fracture. Applicants have found, however, that use of a mixture in a nonproppant stage does not result in unacceptable permeability reduction in the horizontal direction. The exact mixture used will contain at least two separate particle sizes. The exact proportion of the particular particle sizes used will generally have a larger amount of larger particles than smaller particles. For example, a mixture of three parts 10–20 mesh, two parts 20–40 mesh, and one part 100 mesh particles can be used.

It is also not necessary that the particle size distribution is achieved through injection of a mixture of the different size particles. For example, the coarser particles could be injected in a slurry during the leading part of the nonproppant stage, followed by injection of a finer particle slurry. For ease of treatment, though, injection of a mixture of particle sizes in one transport fluid slurry is preferred.

The flow block material of the nonproppant fluid preferably comprises sand. A preferable size distribution comprises a mixture of sand of the following mesh ranges: 3 parts 10–20 , two parts 20–40, and one part 100-mesh sand. Silica flour is also preferably used with the preferred sand mixture in a preferred embodiment of the flow block material of the nonproppant fluid stage.

Any material which would function as a nonproppant, i.e. form the substantially impermeable flow barrier, can be used as the flow block material of the nonproppant stage. The flow block material could thus be, for example, rubber or plastic particles which normally would not yield adequate fluid conductivity when used as a fracture proppant. For such a deformable material, a particle size distribution may not be necessary to form the flow barrier.

After injection of the nonproppant stage, the proppant laden fluid slurry is injected. This slurry contains a proppant with a well-sorted particle size range for propping open the fracture and having high conductivity, for example, 20–40 mesh sand. The fluid employed in the slurry is any fluid useful in a fracturing treatment to place proppant in the induced fracture. The slurry should have the minimum viscosity to transport the proppant. It is preferably injected at lower rates. The lower rates are preferable because they reduce pressures, thus preventing any increase in fracture width in the flow block region which could unseat the block. The amount of proppant slurry injected depends on the horizontal extension of the fracture which is desired and can be calculated by one skilled in the art.

The proppant slurry also displaces the nonproppant stage down the fracture opened by the pad fluid. It is therefore preferable that the viscosity of the proppant laden slurry is lower than that of the nonproppant fluid. A less effective horizontal displacement of the nonproppant stage results and thereby minimizes disturbance of the flow barrier. Moreover, as the nonproppant is displaced down the fracture additional particle bridging and flow blocking will occur in the narrow widths of the fracture. This continues height control unit the nonproppant stage is exhausted.

EXAMPLE

The following example describes two fracture treatments of the same sand formation in East Texas: one used a current fracturing method; the other used the method of the invention. Table I contains the designed fluid injection sequence used in the current treatment. Table II lists the sequence used in the treatment with the method of the invention.

TABLE I

| Fluid Type | Gel Volume (Gals) | Volume Diesel (Gals) | Total Fluid Volume (Gals) | Cumulative Fluid Volume (Gals) | Slurry Volume (Gals) | Cum. Slurry Volume (Gals) | Proppant Concentration (lbs/Gal) | Sand Mesh | Total Proppant (lbs) | Cumulative Proppant (lbs) | Pump Rate (BPM) |
|---|---|---|---|---|---|---|---|---|---|---|---|
| Prepad-VG-1500 | 9,500 | 500 | 10,000 | 10,000 | 10,007 | 10,007 | 15 lb/MGal | Silica Flour | — | — | 25 |
| VG-1500-M | 61,750 | 3,250 | 65,000 | 75,000 | 65,060 | 75,067 | 20 lb/MGal | Silica Flour | — | — | 25 |
| VG-1500-M | 9,500 | 500 | 10,000 | 85,000 | 10,456 | 85,523 | 1 | Silica Flour | 10,000 | 10,000 | 25 |
| VG-1400-M | 9,500 | 500 | 10,000 | 95,000 | 10,912 | 96,435 | 2 | 100 Mesh | 20,000 | 30,000 | 25 |
| VG-1400-M | 14,250 | 750 | 15,000 | 110,000 | 17,052 | 113,487 | 3 | 20–40 | 45,000 | 75,000 | 25 |
| VG-1400 | 14,250 | 750 | 15,000 | 125,000 | 17,736 | 130,539 | 4 | 20–40 | 60,000 | 135,000 | 23 |
| VG-1400 | 20,000 | — | 20,000 | 145,000 | 24,560 | 155,099 | 5 | 20–40 | 100,000 | 235,000 | 21 |
| VG-1300 | 20,000 | — | 20,000 | 165,000 | 25,472 | 180,511 | 6 | 20–40 | 120,000 | 355,000 | 19 |
| VG-1300 | 25,000 | — | 25,000 | 190,000 | 32,980 | 213,551 | 7 | 20–40 | 175,000 | 530,000 | 17 |
| Flush | 8,778 | — | 8,778 | 198,778 | 8,778 | 222,329 | | | — | — | 17 |
| Totals | 192,528 | 6,250 | 198,778 | | 222,329 | | | | 530,000 | | |

NOTES:
M-Contains 5% MeOH.
All 20–40 mesh sand, except last 20 bbls of SLF, to include ½ mc/M lbs of iridium 192 RA material
VG-Halliburton's proprietary fracturing fluid, Versagel

TABLE II

| Fluid Type | Volume Water (Gals) | Volume Diesel (Gals) | Total Fluid Volume (Gals) | Cumulative Fluid Volume (Gals) | Total Volume Sand + Fluid (Gals) | Cumulative Volume Sand + Fluid (gals) | Sand Concentration (ppg) | Total Sand (lbs) | Total Sand (lbs) | Pump Rate (BPM) |
|---|---|---|---|---|---|---|---|---|---|---|
| Terra-T 30 (M) | 9,500 | 500 | 10,000 | 10,000 | 10,000 | 10,000 | 15 lb/M gal | — | — | 26 |
| Terra-T 40 (M) | 21,850 | 1,150 | 23,000 | 33,000 | 23,000 | 33,000 | 20 lb/M gal | — | — | 26 |
| Terra-T 40 (M) | 9,500 | 500 | 10,000 | 43,000 | 10,455 | 43,455 | 1 (10–100 mesh) | 10,000 | 10,000 | 26 |
| Terra-T 30 (M) | 14,250 | 750 | 15,000 | 58,000 | 16,365 | 51,820 | 2 | 30,000 | 40,000 | 26 |
| Terra-T 30 (M) | 14,250 | 750 | 15,000 | 73,000 | 17,048 | 76,868 | 3 | 45,000 | 85,000 | 26 |
| Terra-T 30 | 15,000 | — | 15,000 | 88,000 | 17,731 | 94,599 | 4 | 60,000 | 145,000 | 26 |
| Terra-T 30 | 15,000 | — | 15,000 | 103,000 | 18,413 | 113,012 | 5 | 75,000 | 220,000 | 24 |
| Terra-T 30 | 15,000 | — | 15,000 | 118,000 | 19,096 | 132,108 | 6 | 90,000 | 310,000 | 22 |
| Terra-T 30 | 10,000 | — | 10,000 | 128,000 | 13,186 | 145,294 | 7 | 70,000 | 380,000 | 20 |
| | 124,350 | 3,650 | 128,000 | | 145,294 | | | 380,000 | | |
| Flush | 7,329 | | | | | | | | | |
| | 133,148 | | | | | | | | | |

NOTES:
1. Prepad to include 15 lb/M silica flour and pad to include 20 lb/M silica flour.
2. All 20/40 mesh sand to include 0.3 mc Ir. 192/M lbs. of sand as radioactive tracer.
3. 10–100 mesh is sand mixture of 10–20, 20–40, and mesh sand with silica flour added.
4. Terra-T is a proprietary B. J. Hughes fracture fluid.

Figure 3A:
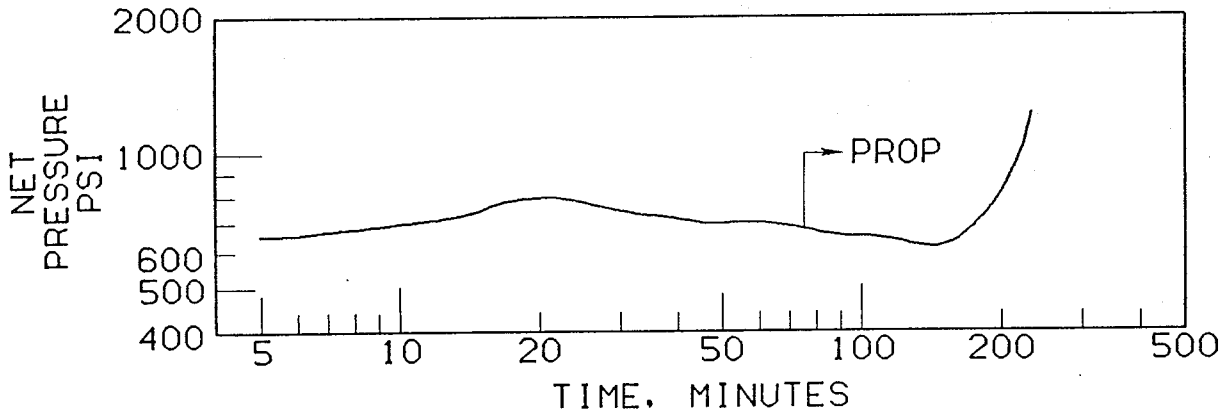
FIG. 3*a* is a bottomhole treating pressure profile during a current hydraulic fracturing treatment in an East Texas formation.
Figure 3B:
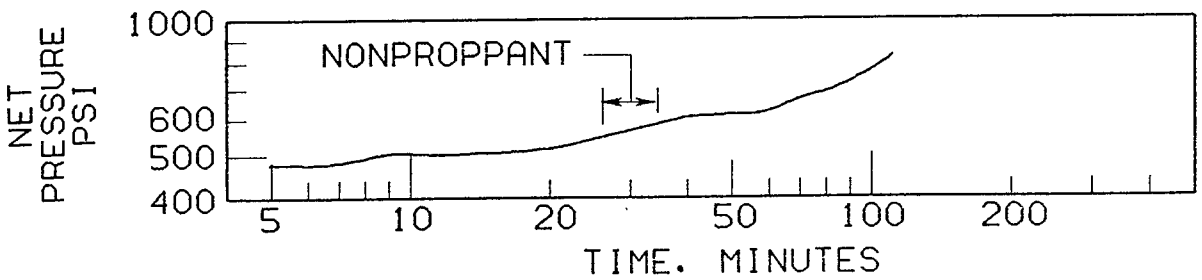
FIG. 3*b* is a bottomhole treating pressure profile of a hydraulic fracturing treatment in the same formation using the method of the invention.

FIGS. 3*a* and 3*b* are log/log plots of net bottomhole treating pressures measured during the current (Table I) and method of the invention (Table II) treatments, respectively plotted against treatment time. Net bottomhole treating pressures are actual pressures measured during the treatment minus the fracture closure pressure. Fracture closure pressure is defined as the pressure at which an unpropped fracture in a particular formation would close. It is believed these pressure profiles can be interpreted to give insights on the effect of a fracture treatment. A discussion of the analysis of these plots can be found in Nolte, K. G. and Smith, M. B., "Interpretation of Fracturing Pressures," Journal of Petroleum Technology, p. 1767, Sept. 1981.

FIG. 3*a* is from the current treatment and shows a decline in treating pressure after a pressure of about 785 psi is reached. This pressure decline is believed characteristic of uncontrolled height growth of the induced fracture. The reason for the decrease in pressure due to unstable height growth is that as the fracture grows upward instead of extending outward in the horizontal direction more fluid flows out of the pay zone to be fractured into formations with lower in-situ stresses. Accordingly, less pressure is required to propagate the fracture and the treating pressure is therefore reduced. FIG. 3*a* shows when proppant injection began, and that shortly afterward the treatment screened out due to slurry dehydration caused by the height growth. This is indicated by the steep pressure increase appearing near the end of the treatment after proppant injection began.

FIG. 3*b* shows in contrast the bottomhole treating pressure during a treatment of the same formation with the method of the invention. As shown in Table II, the nonproppant stage comprised a transport fluid of B. J. Hughes proprietary Terra-T gel and a flow block material consisting of sand and silica flour. The sand is a mixture of three parts 10–20 mesh, 2 parts 20–40 mesh, and one part 100 mesh. Silica flour concentration is 15 lb/1000 gal. The volume of the nonproppant stage is about 8% of the proppant slurry volume. The viscosity of the nonproppant stage is about the same as that for the pad fluid. Injection rate is maintained at the same rate during the pad and nonproppant stages. The period for injection of the proppant stage using the preferred flow block material of the invention is depicted in FIG. 3*b*. The proppant slurry is the Hughes gel containing 20–40 mesh sand, and the slurry was of slightly lower viscosity than the nonproppant stage.

The plot in 3*b* shows only a gradual increase in pressure which is believed indicative of fracture extension in the horizontal direction with restricted height growth. It is believed evident from the pressure profiles the method of the invention using a nonproppant fluid stage has controlled vertical height growth in a formation where previous treatments failed due to excessive fracture height growth.

It is not intended that the invention be limited to the embodiments described. Rather, its scope is given by the following claims.

We claim:

1. A method of hydraulically fracturing an underground formation penetrated by a wellbore, comprising:

(a) injecting a fracturing fluid pad into the formation under conditions of sufficient rate and pressure to create a fracture in the formation;

(b) injecting into the formation a nonproppant fluid stage comprising a transport fluid and a flow block material, the flow block material comprises sand and silica flour with a particle size distribution comprising sand of 10–20, 20–40, and 100 mesh and silica flour of 200 mesh; and (c) injecting a proppant laden fluid slurry into the formation.

2. A method of hydraulically fracturing an underground formation penetrated by a wellbore, comprising:

(a) injecting a fracturing fluid pad into the formation under conditions of sufficient rate and pressure to create a fracture in the formation;

(b) injecting into the formation a nonproppant fluid stage having a volume of about 5 to about 20% of the total volume of a proppant laden fluid slurry injected in Step (c); the nonproppant fluid stage comprises a transport fluid and a flow block material of a particle size distribution sufficient to form a substantially impermeable block to fluid flow in a vertical direction; and (c) injecting a proppant laden fluid slurry into the formation.

3. A method of hydraulically fracturing an underground formation penetrated by a wellbore wherein adverse vertical height growth of the fracture is controlled, comprising:

(a) injecting a fracturing fluid pad into the formation under conditions of sufficient rate and pressure to create a fracture in the formation;

(b) injecting into the formation a nonproppant fluid stage to control vertical height growth of the fracture, said stage having a higher viscosity than the fluid pad and comprising a transport fluid and a flow block material of a particle size distribution sufficient to form a substantially impermeable block to fluid flow in a vertical direction; and (c) injecting into the formation a proppant laden fluid slurry of a lower viscosity than the nonproppant fluid stage of step (b).

* * * * *